US008398036B2

(12) United States Patent
Svedberg

(10) Patent No.: US 8,398,036 B2
(45) Date of Patent: Mar. 19, 2013

(54) POST HOLDER

(75) Inventor: Joakim Svedberg, Frösön (SE)

(73) Assignee: Combisafe International AB, Ostersund (SE)

( * ) Notice: Subject to any disclaimer, the term of this patent is extended or adjusted under 35 U.S.C. 154(b) by 263 days.

(21) Appl. No.: 12/744,433

(22) PCT Filed: Nov. 28, 2008

(86) PCT No.: PCT/EP2008/066397

§ 371 (c)(1),
(2), (4) Date: Jun. 28, 2010

(87) PCT Pub. No.: WO2009/068637

PCT Pub. Date: Jun. 4, 2009

(65) Prior Publication Data

US 2010/0270451 A1 Oct. 28, 2010

(30) Foreign Application Priority Data

Nov. 30, 2007 (EP) ..... 07023238

(51) Int. Cl.
*A45F 4/04* (2006.01)
*E04H 12/00* (2006.01)

(52) U.S. Cl. ..... 248/154; 52/146; 52/151; 52/152; 248/523

(58) Field of Classification Search ..... 248/156, 248/345.1, 188.1, 545, 154, 519, 523, 536, 248/440, 218.4, 188.4, 188.8, 188.91, 903; 473/406, 408; 52/165, 38, 154, 244, 298, 52/146, 151, 152, 153, 164; 211/183, 191
See application file for complete search history.

(56) References Cited

U.S. PATENT DOCUMENTS

| | | | | | |
|---|---|---|---|---|---|
| 3,100,033 | A * | 8/1963 | Hanson | 403/391 |
| 4,088,229 | A * | 5/1978 | Jacoby et al. | 248/188.8 |
| 4,320,608 | A * | 3/1982 | Deike | 52/165 |
| 4,553,358 | A * | 11/1985 | Deike | 248/519 |
| 5,369,925 | A * | 12/1994 | Vargo | 52/244 |
| 5,431,372 | A | 7/1995 | Kostelecky | |
| 5,749,180 | A * | 5/1998 | Jewett et al. | 52/154 |
| 5,848,502 | A * | 12/1998 | Schaefer | 248/156 |
| 6,038,829 | A | 3/2000 | Franks | |
| 7,104,514 | B2 * | 9/2006 | Ciarlo | 248/345.1 |
| 2001/0045554 | A1 * | 11/2001 | Pulliam | 256/65 |

FOREIGN PATENT DOCUMENTS

| | | |
|---|---|---|
| CZ | 546 331 A | 2/1974 |
| DE | 28 19 062 A1 | 10/1979 |

* cited by examiner

*Primary Examiner* — Tan Le
(74) *Attorney, Agent, or Firm* — Wood, Phillips, Katz, Clark & Mortimer

(57) ABSTRACT

A post holder for holding a safety post on a horizontal structure of a building is provided. The post holder has an elongate post reception portion an elongate central support portion, protruding from the post reception portion and perpendicular to the post reception portion, and first and second elongate side support portions protruding from the post reception portion laterally of the central support portion and in opposite directions. The central support portion comprises a fastening seat, which is arranged to receive a fastening member for fastening of the post holder to a base. Each one of said support portions comprises a support protrusion, which constitutes a fraction of the support portion at a bottom side thereof and protrudes at a bottom side thereof, thereby forming a lower most support surface of the support portion. The lower most support surfaces of the support portions are triangularly positioned.

8 Claims, 5 Drawing Sheets

POST HOLDER

FIELD OF THE INVENTION

The present invention relates to safety systems in general, and in particular to a post holder for a safety post to be temporary arranged on a horizontal structure of a building.

BACKGROUND OF THE INVENTION

Safety posts in the respect of this application are used as parts of a building safety system, such as an edge protection on a building, which, for instance during construction, renovation or demolition, prevents workers or tools from falling down. A safety post is mountable in a post holder, which in turn is mounted on a horizontal structure of the building.

A prior art post holder is shown in FIGS. 1*a* and 1*b*. It has an elongate post reception portion 102, and a support portion 104 protruding from said post reception portion perpendicularly to the post reception portion. The support portion has two opposite side walls 106 extending in parallel at a distance from each other and being interconnected by a transverse wall 108. The post holder 100 is arranged to be fastened by a screw 110, which is introduced between said side walls and screwed into a recess 112 of the base that the post holder rests on. A washer 114 having a diameter that is lager than said distance is placed around the screw 110 and positioned on top of the side walls in order to clamp the post holder in place. This prior art post holder has shown not to be stable enough for some applications.

SUMMARY OF THE INVENTION

It is an object of the present invention to provide a post holder that alleviates the above-mentioned drawbacks of the prior art and is stable enough for all kinds of applications.

This object is achieved by a post holder according to the present invention as defined in claim 1.

The invention is based on an insight that by widening the post holder at the post reception portion the best stabilizing effect is obtained.

Thus, in accordance with an aspect of the present invention, there is provided a post holder for holding a safety post, which post holder comprises an elongate post reception portion, an elongate central support portion, protruding from said post reception portion and perpendicular to the post reception portion, and first and second elongate side support portions protruding from said post reception portion laterally of said central support portion and in opposite directions, wherein said central support portion comprises a fastening seat, which is arranged to receive a fastening means for fastening of the post holder. Each one of said support portions comprises a support protrusion, which constitutes a fraction of the support portion at a bottom side thereof and protrudes at a bottom side thereof, thereby forming a lower most support surface of the support portion. The lower most support surfaces of the support portions are triangularly positioned In other words the support portions extend in the same plane in three different directions, and form a kind of triangular three point support, which is stable in all directions. Further, the support protrusions thus have a limited extension and are spaced from each other. Thereby they represent three contact points of the post holder, which when the post holder is placed on an uneven base surface, as often is the case, ensure that the post holder stands steady and is not rickety. This is in contrast to the above-described prior art post holder which is sensitive to rough or uneven base surfaces, since it has a long bottom surface formed by the bottom sides of the side walls and the post reception portion.

In accordance with an embodiment of the post holder said first and second side support portions extend perpendicularly to said central support portion. This is advantageous as regards the ability to absorb side forces on a safety post that is mounted at the post holder.

In accordance with an embodiment of the post holder the central support portion comprises two side walls extending longitudinally of the central support portion at a distance to each other, and they are interconnected at an end thereof, i.e. at the outer ends of the side walls at a distance from the post reception portion, and the fastening seat comprises a bridge plate bridging the distance between, and being fastened at, said side walls, which bridge plate is provided with a hole. As is understood the fastening means will be passed through the hole of the bridge plate to reach the base beneath the bridge plate. The bridge plate constitutes a rigid washer. This structure has the advantage that the fastening means may be of smaller dimensions as compared to what has to be used in the prior art post holder described above.

In accordance with an embodiment of the post holder, it further comprises an elongate fastening member, which has been received at the fastening seat and which extends through said hole of the bridge plate. The longitudinal position of the fastening member relative to the hole is adjustable Thereby the length to which the fastening member extends below the hole is adjustable in dependence of the type of base on which it is placed, the depth of the recess in the base, etc.

In accordance with an embodiment of the post holder, the fastening member comprises a threaded pin, which has been introduced into the bridge hole from below, and which has a flange that is arranged below the hole and has a diameter exceeding that of the hole. Further, the fastening member comprises a retaining nut, which has been screwed onto the pin from the top end thereof after the introduction into the hole. Thus, the retaining nut and the flange, inter alia, keep the pin from falling out of the hole in either direction.

In accordance with an embodiment of the post holder, each respective side support portion comprises two side walls extending longitudinally of the central support portion at a distance to each other and being interconnected at an end thereof. This means, inter alia, that the side support portions can be formed similar to the central support portion, which at least is an advantage of manufacture.

In accordance with another aspect of the present invention there is provided a post holder kit comprising a post holder as described above, and a tray which is arranged to receive the post holder. The tray comprises a bottom and a circumferential wall and has a shape that is adapted to the overall shape of the post holder, said bottom having a hole for letting said fastening means pass. The tray adds an interesting advantage to the post holder by protecting it from being soiled with concrete when casting a new layer on the base around the post holder. The tray can be easily exchanged after use leaving the post holder immediately ready for a new task without having to first clean it. Additionally the tray leaves a geometrically well defined recess, which is easy to fill with concrete after having removed the post holder kit. Moreover, it is possible to manufacture the tray in plastic.

In an embodiment of the post holder kit, the tray widens from the bottom and up, which facilitates the removal thereof after having cast a new concrete layer on the base.

These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1A:
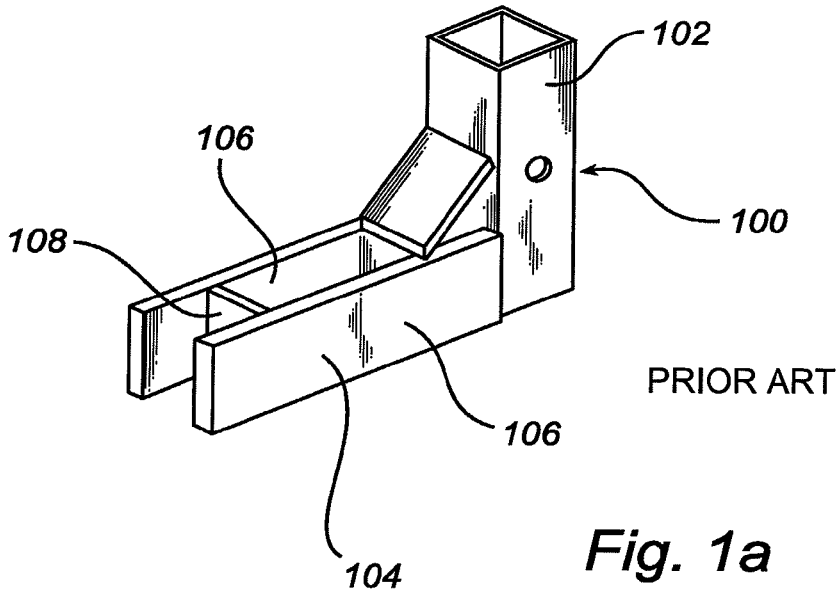
FIGS. 1*a* and 1*b* shows a prior art post holder.
Figure 1B:
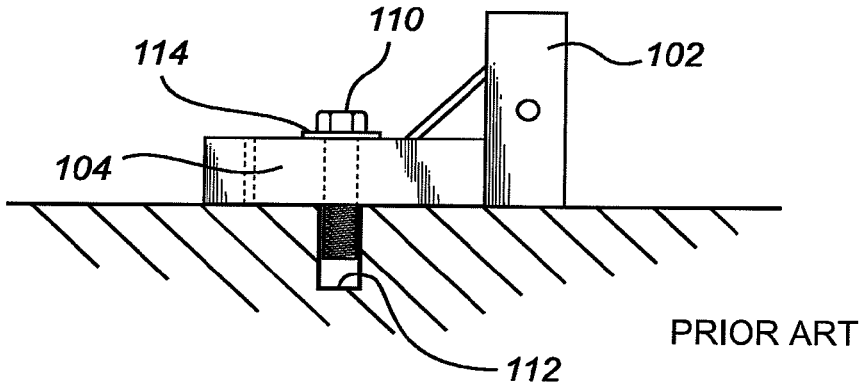
Figure 2:
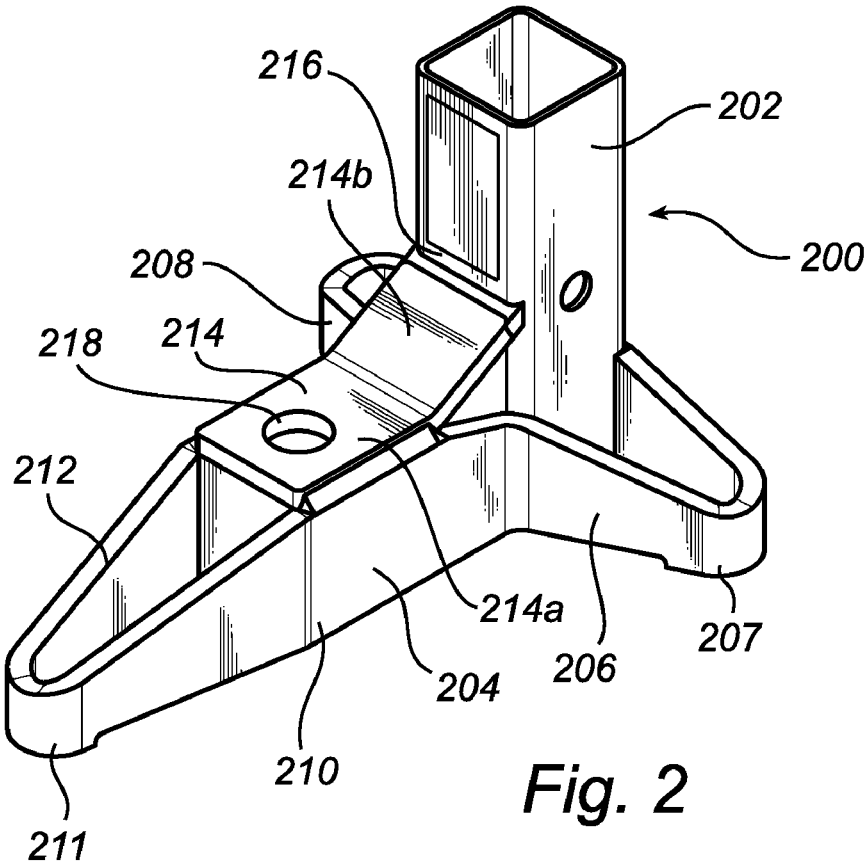
FIG. 2 is a schematic perspective view of an embodiment of a post holder according to the present invention.

Referring to FIG. 2 the post holder 200 in a first embodiment thereof comprises an elongate post reception portion 202, an elongate central support portion 204, and respective first and second elongate side support portions 206 and 208. The post reception portion 202 is a standing tube, here a square tube, i.e. the tube 202 extends vertically in a use position, and is arranged for receiving a safety post, see FIG. 5, which is put down into the tube 202. The tube 202 has a locking hole 210 at least on one side thereof, which is arranged to engage with a locking pin or the like at the safety post. The central support portion 204 protrudes forwardly from the post reception portion 202, and it protrudes perpendicularly to the post reception portion 202, and thus horizontally in the use position. Said first side support portion 206 also protrudes from the post reception portion 202, and perpendicularly thereto, but laterally thereof, and, thus, laterally of the central support portion 204. The second side support portion 208 extends similarly to the first support portion 204 but in the opposite lateral direction. Thus the first and second side support portions 206, 208 extend perpendicularly of the central support portion 204. In alternative embodiments the side support portions can extend at other angles to the central support portion but the right angles are preferred.

Figure 3:
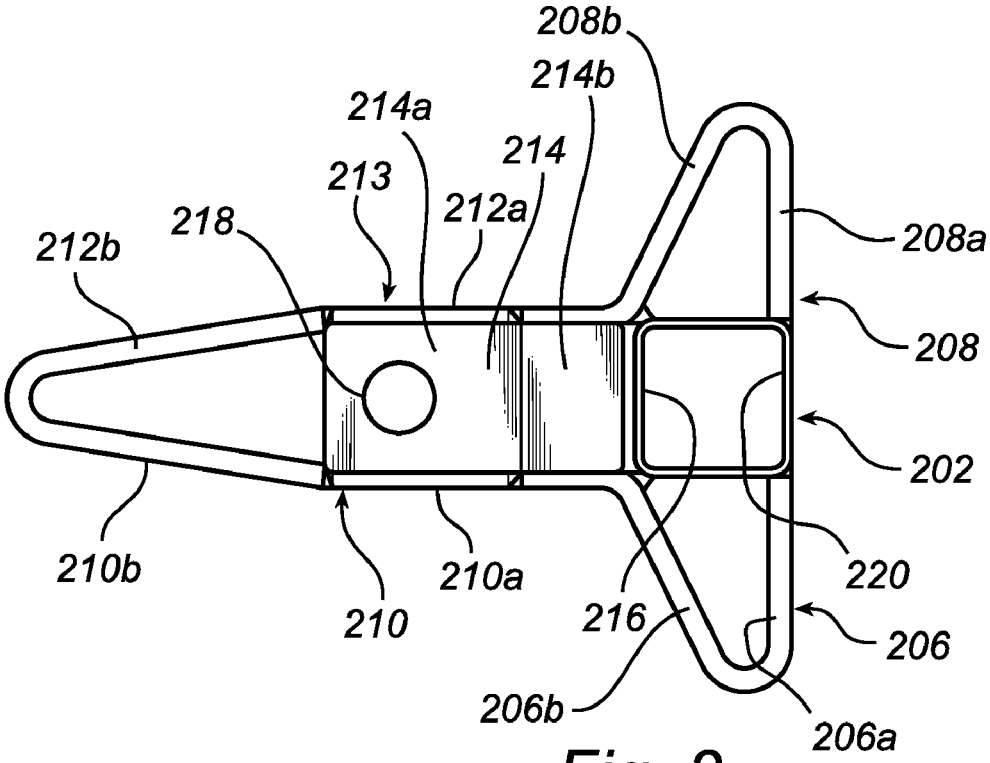
FIG. 3 is a schematic plan view of the post holder of FIG. 2.

Referring now also to FIG. 3, the central support portion comprises first and second opposite side walls 210, 212, which are plate shaped. Each side wall 210, 212 is attached, at one end thereof, to the tube 202, and at the other end, distant from the tube 202, it is interconnected, i.e. joined, with the other side wall 212, 210. More particularly, a first wall portion 210*a* of the first side wall 210 extends from the tube 202 from a front corner thereof to about half the length of the central support portion 204, and a second wall portion 210*b* of the first side wall 210 extends from the end of the first wall portion at an angle thereto, to said other end of the first side wall 210. Similarly the second side wall 212 has first and second wall portions 212*a* and 212*b* extending mirrored to the wall portions of the first side wall 210 from the other front corner of the tube 202 to the other end of the second side wall 212. Thus the first wall portions 210*a* and 212*a* extend in parallel to each other at a distance corresponding to the width of the tube 202, and the second wall portions 210*b* and 212*b* are closing in towards the end of the central support portion 204. Additionally the first wall portions 210*a*, 212*a* have a constant height, while the second wall portions 210*b*, 212*b* are sloping towards the end of the central support portion 204.

Further, the central support portion 204 comprises a fastening seat 214, which forms the top thereof. The fastening seat 214 comprises a bridge plate 214*a*, which bridges the distance between, and is attached to, the first wall portions 210*a*, 212*a* of the side walls 210, 212. Thus the bridge plate constitutes a roof of the central support portion 204. The fastening seat further comprises a reinforcement plate 214*b*, which is inclined upwards from the bridge plate 214*a* to the front wall 216 of the tube 202. The bridge plate 214*a* is provided with a hole 218 through which a fastening member, such as a screw, is put when the post holder 200 is to be fastened at the base. The side support portions 206, 208 are similarly shaped and mirrored in a vertical plane in which a horizontal centre axis of the central support portion 204 extends. The first side support portion comprises a first side wall 206*a*, which is aligned with a rear wall 220 of the tube 202, and a second side wall 206*b*, which extends obliquely rearwards from the front corner of the tube 202 to the outer end of the first side support portion 206, where it is joined with the first wall portion 206*a* of the first side support portion 206. Both side walls 206*a*, 206*b* of the first side support portion 206 are sloped from the tube 202 towards the outer end of the first support portion 206. The second side support portion 208 likewise comprises first and second wall portions 208*a*, 208*b*, which are arranged correspondingly to the wall portions 206*a*, 206*b* of the first side support portion 206 but mirrored in relation to them. It should be noted that for reasons of simplifying manufacture and obtaining maximum strength the side walls of all three support portions 204, 206, 208 are preferably formed from a single elongate plate, which is bent at appropriate locations thereof in order to obtain the desired shape, and which is attached to the rear corners of the post reception portion, i.e. the tube, 202, at the very ends thereof, and to the front corners of the tube 202 at attachment portions located at equal distances from the respective ends of the single elongate plate.

At the outer end of the first side support portion 206 it has a support protrusion, or heel, 207, which protrudes at a bottom side of the first side support portion 206. In other words, a fraction of the first side support portion, at the outer end thereof, forms a lower-most bottom area, which rests on the base on which the post holder 200 is placed. The second side support portion 208 is identically formed, and the central support portion 204 has a corresponding support protrusion 211 at its front end. Thereby the post holder 200 can be regarded as standing on three points, which are triangularly positioned, and in this embodiment positioned as far from each other as possible within the extension of the post holder 200. If the base is uneven, e.g. knobbly, the post holder 200 still is able to stand stably.

Figure 4:
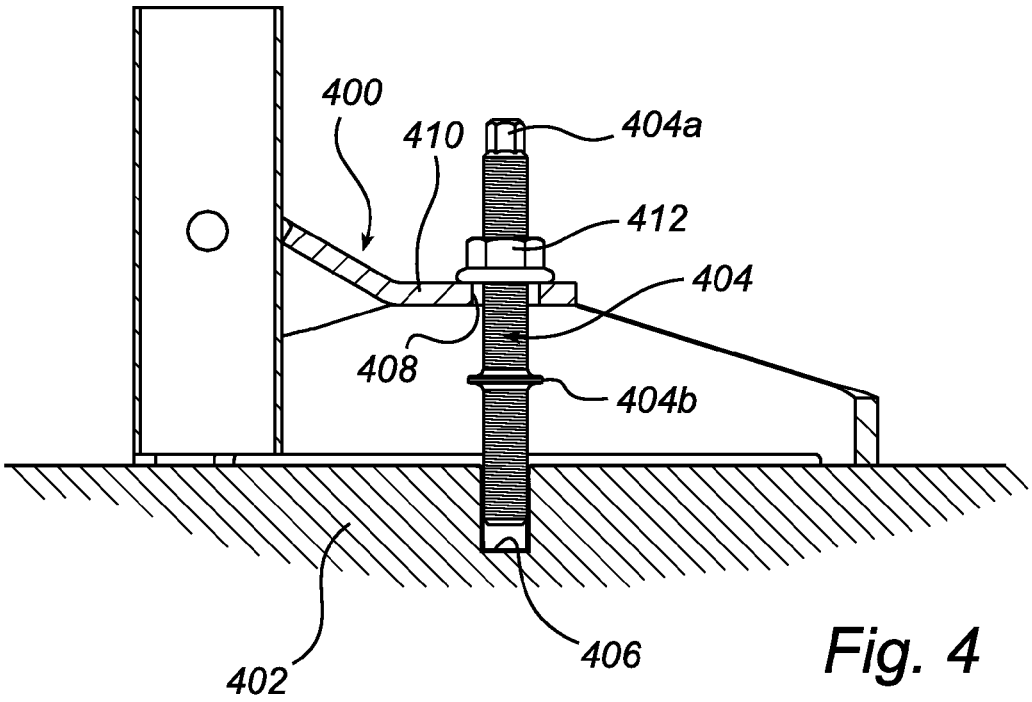
FIG. 4 is a schematic partly cross-sectional view in side elevation of the post holder of FIGS. 2 and 3.

As shown in FIG. 4, in a use position, the post holder 400 is placed on a base 402, such as a concrete floor of a building structure. The post holder 400 is shown as including a fastening member 404. The post holder 400 is fastened to the base 402 by means of the fastening member 404, which is fastened into a recess 406 of the base 402, or which is preattached to the base 402 and protrudes upwards from the base 402. Preferably, as shown in FIG. 4, the fastening means 404 is a screw, which is introduced into the hole 408 of the fastening seat 410. In this particular embodiment of the fastening member the screw 404 is a threaded pin having a nut shaped head 404*a*, the diameter of which is smaller than that of the hole 408, and a flange 404*b* arranged at about the middle of the pin and having a diameter exceeding that of the hole 408. Thus, the screw 404 is introducible into the hole 408 from below and has a retaining nut 412, which has been screwed onto the pin from the top end thereof after the introduction into the hole 408. For the case where the screw 404 accompanies the post holder 400, the nut 412 retains the screw 404 at the fastening seat 410. More particularly, the nut 412 keeps the pin from falling off when the post holder 400 is upright, and the flange 404*b* keeps it from falling off when the post holder 400 is upside down.

Figure 5:
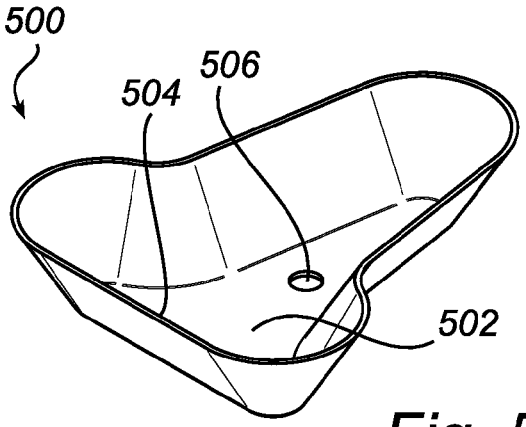
FIG. 5 is a schematic perspective view of an embodiment of a tray that is used in conjunction with a post holder.

A post holder kit comprises the post holder, with or without the fastening member, and a tray 500, which is illustrated in FIG. 5. The tray 500 comprises a bottom 502, and a circumferential wall 504. The tray 500 has a shape that is adapted to the overall shape of a corresponding post holder, In the illustrated case the shape of the tray 500 is adapted to that of the post holder described above. The bottom has a hole 506 for letting said fastening member pass. The wall 504 of the tray 500 is inclined outwards, i.e. the tray 500 widens from the bottom 502 and up. The tray 500 is a protection tray, which protects the post holder from being smeared with construction masses, such as concrete, which are applied onto the horizontal structure, i.e. base, where the post holder 200 is placed.

Figure 6:
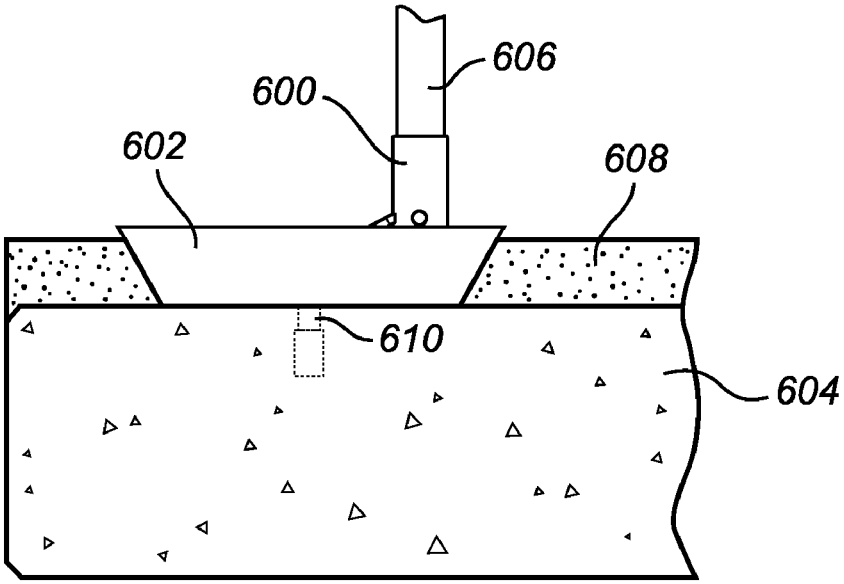
FIG. 6 is schematic side view of an embodiment of a post holder kit mounted at a base, shown in cross-section, and holding a safety post.
Figure 7:
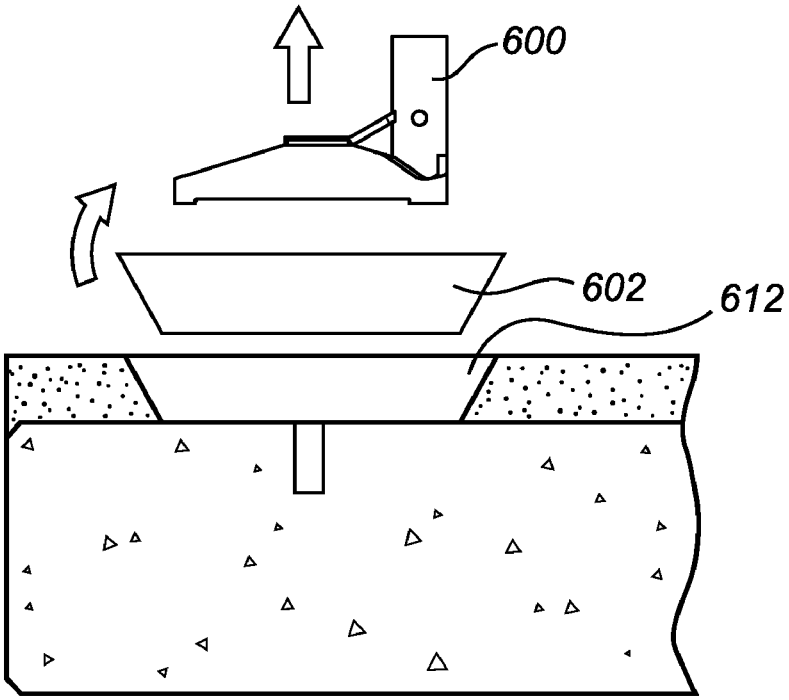
FIG. 7 schematically illustrates the removal of the post holder kit of FIG. 5.

As shown in FIG. 6, the tray 602 has been placed on a base 604 and the post holder 600 has been placed in the tray 602. A safety post 606 has been mounted in the post holder 600, and the, thus formed, post holder kit 600, 602 has been fastened in the base 604 by means of a fastening member 610, which extends through the hole in the fastening seat of the post holder 600 and the hole in the bottom of the tray 602, as has been illustrated in FIGS. 2 and 5. A new concrete layer 608 has been cast onto the base 604, and surrounds the tray 602. The thickness of the concrete layer is less than the height of the tray wall. Consequently, the post holder 600 is still clean, since it is protected by the tray 602. It is easy to remove the safety post 606, the post holder 600, and the tray 602, as illustrated in FIG. 7, which leaves a relatively small pit 612 having smooth walls. It is then a simple task to fill the pit with concrete in order to complete the casting.

Figure 8:
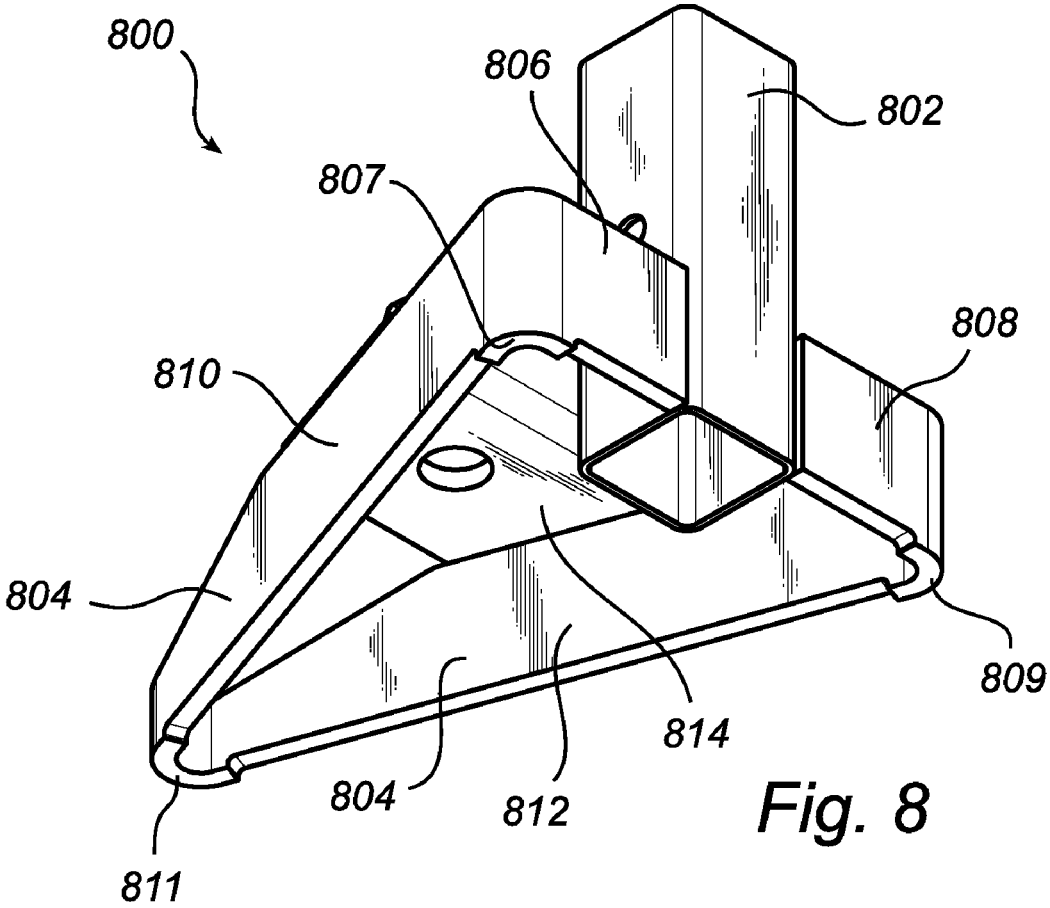
FIG. 8 is a schematic perspective view of another embodiment of the post holder according to the present invention.

According to a second embodiment of the post holder 800, as shown in FIG. 8, it comprises an elongate post reception portion 802, an elongate central support portion 804, and respective first and second elongate side support portions 806 and 808. The post reception portion 802 is a standing tube, similar to the post reception portion 202 of the first embodiment described above. The central support portion 804 protrudes forwardly from the post reception portion 802, and it protrudes perpendicularly to the post reception portion 802, and thus horizontally in the use position. Said first side support portion 806 also protrudes from the post reception portion 802, laterally thereof. The second side support portion 808 extends in a similar way as the first support portion 804 but in the opposite lateral direction. Thus the first and second side support portions 806, 808 extend perpendicularly of the central support portion 804, when comparing their main extension direction.

Moreover, similar to the first embodiment, the central support portion of this second embodiment has two ribbon-shaped side walls 810, 812, which extend at a distance from each other and are interconnected at a front end of the central support portion 804. However, here they extend at an angle to each other along their full length. In other words, the side walls 810, 812 form a V. Each side support portion 806, 808 is constituted by a single ribbon-shaped portion, and is interconnected with a respective one of the side walls 810, 812 at an angle to the side wall. The central support portion 804 and the side support portions 806, 808 together form a triangularly shaped support member. Preferably the support member 804, 806, 808 is made by bending an elongate, or ribbon-shaped, plate at three locations and leaving room for the tube 802 between the ends of the plate, which ends are attached to the tube 802. Similar to the first embodiment each one of the central, first and second support portions 804, 806, 808 is provided with a support protrusion 811, 807, 809 forming a lower-most fraction of the support portion. The support protrusions are positioned at the bends of the elongate plate.

Above, embodiments of the post holder according to the present invention as defined in the appended claims have been described. These should be seen as merely non-limiting examples. As understood by a skilled person, many modifications and alternative embodiments are possible within the scope of the invention.

For example, the post reception portion can have other shapes than square as has been shown herein. For example it can have a circular cross-section adapted to round posts.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A post holder for holding a safety post, which post holder comprises an elongate post reception portion, an elongate central support portion, protruding from said post reception portion and perpendicular to the post reception portion, and first and second elongate side support portions protruding from said post reception portion laterally of said central support portion and in opposite directions, wherein said central support portion comprises a fastening seat, which is arranged to receive a fastening member for fastening of the post holder, and two side walls extending longitudinally of the central support portion at a distance to each other, and being interconnected at an end thereof, wherein said fastening seat comprises a bridge plate bridging the distance between, and being fastened at, said side walls, which bridge plate is provided with a hole, wherein each one of said support portions comprises a support protrusion, which constitutes a fraction of the support portion at a bottom side thereof and protrudes at a bottom side thereof, thereby forming a lower most support surface of the support portion, and wherein said lower most support surfaces of said support portions are triangularly positioned.

2. A post holder according to claim 1, wherein said first and second side support portions extend perpendicularly to said central support portion.

3. A post holder according to claim 1, further comprising an elongate fastening member received at said fastening seat and extending through said hole of the bridge plate, wherein the longitudinal position of the fastening member relative to the hole is adjustable.

4. A post holder according to claim 3, wherein said fastening member comprises a threaded pin, which has been introduced into said hole from below, and which has a flange that is arranged below the hole and has a diameter exceeding that of the hole, and wherein said fastening member comprises a retaining nut, which has been screwed onto the pin from the top end thereof after the introduction into the hole.

5. A post holder according to claim 1, wherein each respective side support portion comprises two side walls protruding from said post reception portion and being interconnected at an end thereof.

6. A post holder kit comprising a post holder according to claim 1, and a tray which is arranged to receive said post holder, wherein said tray comprises a bottom and a circumferential wall and has a shape that is adapted to the overall shape of the post holder, said bottom having a hole for letting said fastening member pass.

7. A post holder kit according to claim 6, wherein said tray widens from the bottom and up.

8. A post holder according to claim 2, wherein each respective side support portion comprises two side walls protruding from said post reception portion and being interconnected at an end thereof.

* * * * *